US008375910B2

(12) United States Patent
Becker et al.

(10) Patent No.: US 8,375,910 B2
(45) Date of Patent: Feb. 19, 2013

(54) ANTI-ROTATION DEVICE FOR A COUPLING PISTON IN A SWITCHABLE COMPONENT OF A VALVE TRAIN OF AN INTERNAL COMBUSTION ENGINE

(75) Inventors: Matthias Becker, Herzogenaurach (DE); Robert Heinemann, Weisendorf (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 248 days.

(21) Appl. No.: 12/851,581

(22) Filed: Aug. 6, 2010

(65) Prior Publication Data

US 2011/0056446 A1 Mar. 10, 2011

(30) Foreign Application Priority Data

Sep. 4, 2009 (DE) ..... 10 2009 039 720

(51) Int. Cl.
*F01L 1/14* (2006.01)

(52) U.S. Cl. ..... 123/90.5; 123/90.52; 123/90.16

(58) Field of Classification Search ..... 123/90.48, 123/90.52, 90.5, 90.59, 90.43, 90.16
See application file for complete search history.

(56) References Cited

U.S. PATENT DOCUMENTS

2003/0075129 A1* 4/2003 Spath et al. ..... 123/90.16

FOREIGN PATENT DOCUMENTS

EP 1149989 6/2005

* cited by examiner

*Primary Examiner* — Zelalem Eshete
(74) *Attorney, Agent, or Firm* — Volpe and Koenig, P.C.

(57) ABSTRACT

An anti-rotation device (1) for a coupling piston (2) in a switchable component (3) of a valve train of an internal combustion engine is provided, with the component (3) including two parts (4, 5) that are movable relative to each other. The coupling piston (2) is displaced into a bore (6) of one of the two parts (4) for achieving uncoupling, and the coupling piston (2) comprising, at least on one side (8), a flattened portion (9) starting from a front end (7) of the coupling piston (2) facing another one of the two parts (5), through which flattened portion (9), during a relative movement of the two parts (4, 5), the coupling piston (2) is displaced onto an entraining surface (11) arranged on the another one of the two parts (5) for achieving coupling, the anti-rotation device (1) being configured as a fractional region of an opening (13) of the bore (6) on a bridge component spanning the one part (4), and the coupling piston (2) being guided through its flattened portion (9) on a bowstring-like transverse surface (14) of the bridge component.

14 Claims, 2 Drawing Sheets

ANTI-ROTATION DEVICE FOR A COUPLING PISTON IN A SWITCHABLE COMPONENT OF A VALVE TRAIN OF AN INTERNAL COMBUSTION ENGINE

CROSS-REFERENCE TO RELATED APPLICATIONS

This application claims the benefit of German Patent Application No. 10 2009 039 720.5, filed Sep. 4, 2009, which is incorporated herein by reference as if fully set forth.

FIELD OF THE INVENTION

The invention concerns an anti-rotation device for a coupling piston in a switchable component of a valve train of an internal combustion engine, said component comprising two parts that are movable relative to each other, said coupling piston being displaced by a first servo into a bore of one of the two parts for achieving uncoupling [low or zero valve lift], said coupling piston comprising, at least on one side, a flattened portion starting from a front end of the coupling piston facing another one of the two parts, through which flattened portion, during a relative movement of the two parts, the coupling piston is displaced by a second servo onto an entraining surface arranged on the another one of the two parts for achieving coupling [high valve lift], and a cam resetting spring being clamped between the two parts.

BACKGROUND

A generic anti-rotation device, in this case, for a coupling piston of a switchable roller tappet, is disclosed in FIG. 6 of EP 1 149 989 B1 (which is not reproduced here). This document discloses an open circular wire which is seated on the outer peripheral wall of the inner element and extends under the flattened portion of the respective coupling piston. In addition, FIG. 4 of this document also shows an anti-rotation device for the coupling piston, said anti-rotation device being constituted by a pin seated in longitudinal grooves.

A drawback of the first-mentioned circular wire variant is its inadequate rigidity for enabling a displacement limitation and an anti-rotation feature. Thus, there is a danger of an excessive twisting of the coupling piston, so that one of the piston edges comes to be situated under the coupling surface, which leads to wear or makes coupling impossible. Moreover, the circular wire can expand to an undesired extent. Furthermore, assembly has to be done in the right direction.

The aforesaid second, pin variant requires a great deal of assembly work and leads to high fabrication costs.

SUMMARY

The object of the invention is therefore to provide an anti-rotation device of the above-noted type in which the aforesaid drawbacks are eliminated. In particular, it is the object of the invention to create an anti-rotation device, and optionally, simultaneously, a stop, which is robust, easy to assemble and possesses a high quality of rotation prevention.

The invention achieves the above objects by the fact that the anti-rotation device is configured as a fractional region of an opening of the bore on a bridge component spanning the one part, the coupling piston being guided through its flattened portion on a bowstring-like transverse surface of the bridge component.

In this way, the aforesaid drawbacks are eliminated. The invention creates a robust, easy-to-assemble anti-rotation device which optionally also constitutes an outward movement limitation for the coupling piston. The coupling piston receives an excellent guidance on the bowstring-like transverse surface of the bridge component.

The bridge component is made preferably of thin-walled sheet metal, for example, by a punching or a punching and bending method and can be connected through a simple welded or clamped connection to the one part (inner element).

According to an advantageous development of the invention, the bridge component can be configured either a) as a plate or ring segment, b) as a ring or c) as a bottom segment of a small tube extending in the bore of the one part. The person skilled in the art will choose the variant most advantageous for his purpose.

Although the coupling piston, as claimed, comprises a flattened portion, it is both conceivable and intended within the scope of the invention to use various other configurations, for instance, arched configurations etc. At the same time, the counter surface on the other part does not necessarily have to have a complementary configuration.

A suitable servo for loading the coupling piston in one or both directions can be, for instance, a hydraulic medium, a compression spring, a magnetic or an electromagnetic element.

If the one part is cylindrical in shape, as is possible in the case of an inner element of a switchable component configured as a roller tappet, a cup-shaped tappet or a support element, it is also possible to use two coupling pistons situated diametrically opposite each other, both of which then cooperate with an anti-rotation device according to the invention. Exactly in this case, it is appropriate to make the entraining surface on the other part, for instance, as an easy-to-fabricate annular groove or annular groove segment in the bore of the other part or as a window-like interruption or depression.

However, it is also possible to consider a lever system such as a switchable finger lever, an oscillating arm or a rocker arm as a switchable component. The two parts are then the arms adjoining each other and the entraining surface can be, for example, a window or a bar surface (longitudinal bar or crossbar) on the respective other arm.

It is particularly advantageous, if an outward movement limitation for the coupling piston is realized at the same time through an abutment of a transverse shoulder of the coupling piston against an inner side of the bridge component.

In this way, it is possible to dispense with other stops which become necessary for achieving uncoupling, for example, in the case of differential lifts of the two parts.

DETAILED DESCRIPTION OF THE PREFERRED EMBODIMENTS

Figure 1:
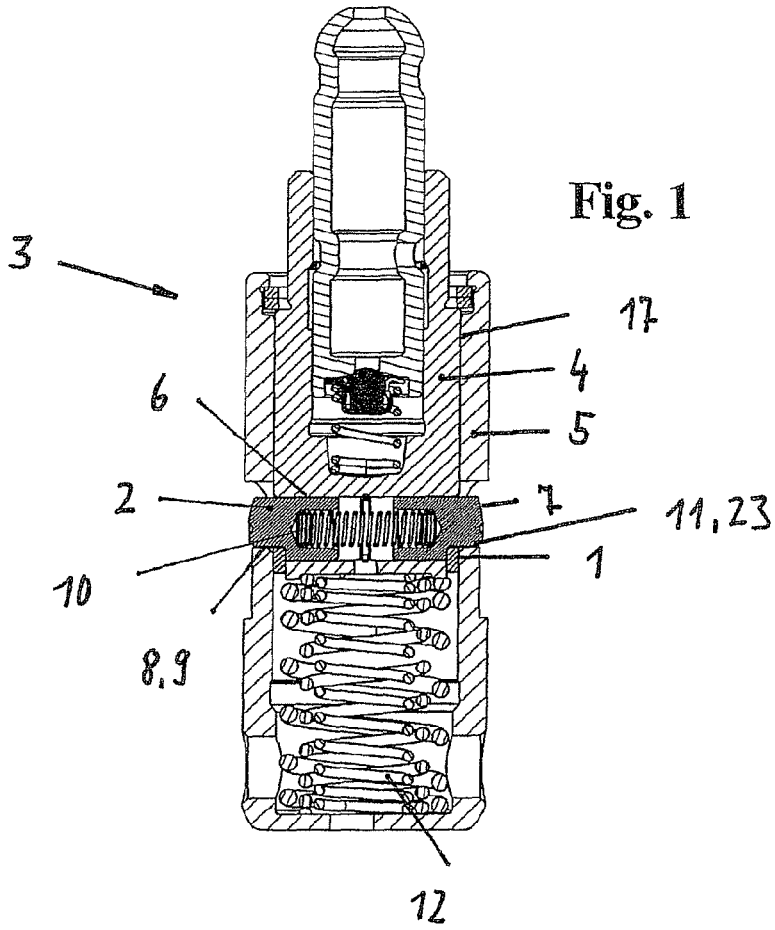
FIG. 1 is a longitudinal section view through a switchable component configured as a support element of a finger lever.

FIG. 1 discloses a switchable component 3 configured as a support element of a valve train of an internal combustion engine. The component 3 comprises two parts 4, 5 which are axially movable relative to each other, the part 4 being configured as an inner element and the part 5 as a housing for the inner element. Two coupling pistons 2 are situated diametrically opposite each other in a radial through-bore 6 in the part 4. The coupling pistons 2 comprise, starting from an outer front end 7, on an underside 8, a partial flattened portion 9 comprising a transverse shoulder 25.

FIG. 1 discloses a coupled state in the switchable component 3, in which state, the coupling pistons 2 engage over a parting surface between the parts 4, 5 and are seated with their flattened portions 9 on respective entraining surfaces 11 in the other part 5. The entraining surfaces 11 are a constituent part of window-like openings 23.

A cam resetting spring 12 (coil compression spring) is clamped between the parts 4 and 5.

The coupling pistons 2 are biased in coupling direction by a servo device 10 configured, in the present case, as a compression spring, while being displaceable in uncoupling direction completely into the bore 6 in the one part 4 by hydraulic medium as a further servo device.

Each coupling piston 2 comprises an anti-rotation device 1 which, according to the invention, is configured as a fractional region of an opening 13 of its bore 6 on a bridge component spanning the one part 4. The bridge component comprises on an upper side, a bowstring-like transverse surface 14 on which the coupling piston 2 is guided with its flattened portion 9 in anti-rotation direction. At the same time, an outward movement limitation for each coupling piston 2 is realized through the transverse shoulder 25 configured on an inner side 24 of the bridge component 1.

Figure 2:
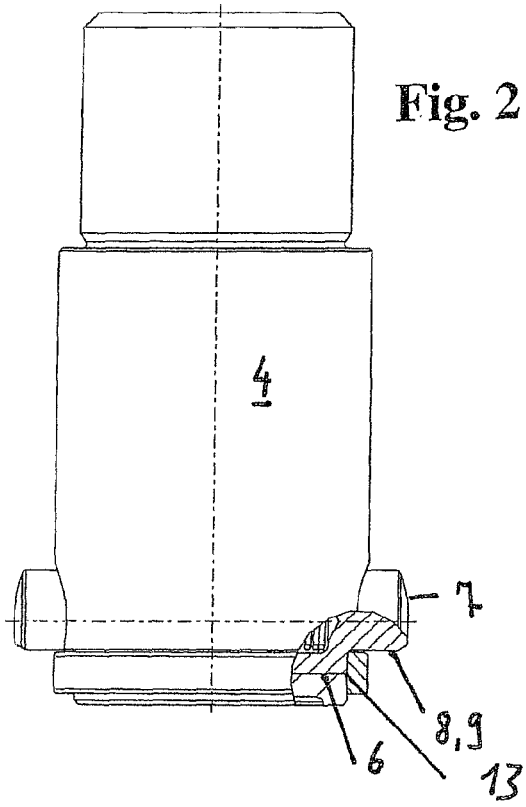
FIGS. 2, 3 are views of a part configured as an inner element of the support element, comprising a ring as a bridge component.
Figure 3:
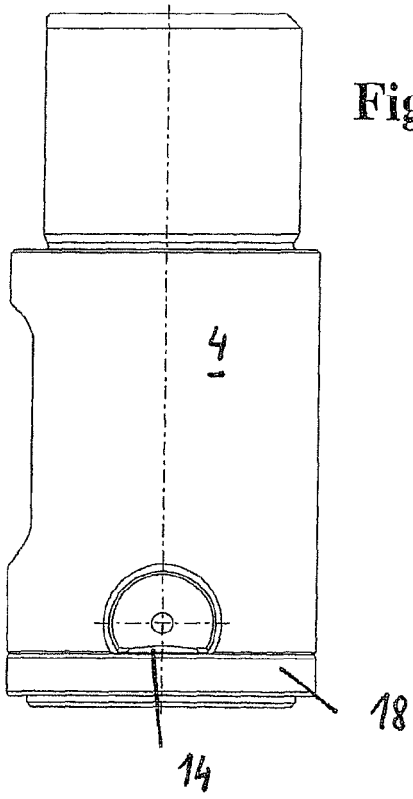

According to FIGS. 2 and 3, the bridge component 1 is configured as a belt-like ring 18 which is seated on the outer peripheral surface 17 on the one part 4. Each coupling piston 2 engages with its flattened portion 9 over the transverse surface 14 of the ring 18, configured in the present case as a front end surface.

Figure 4:
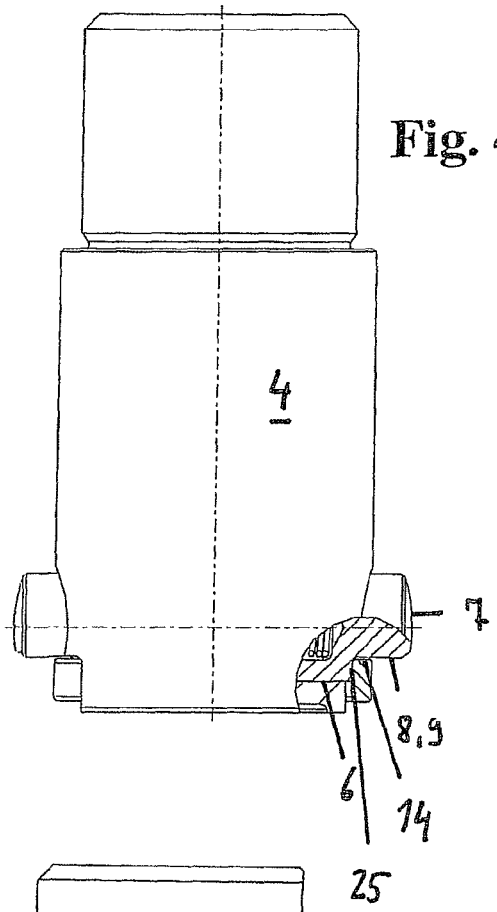
FIGS. 4, 5 are views of an alternative to the preceding embodiment, comprising a ring segment as a bridge component
Figure 5:
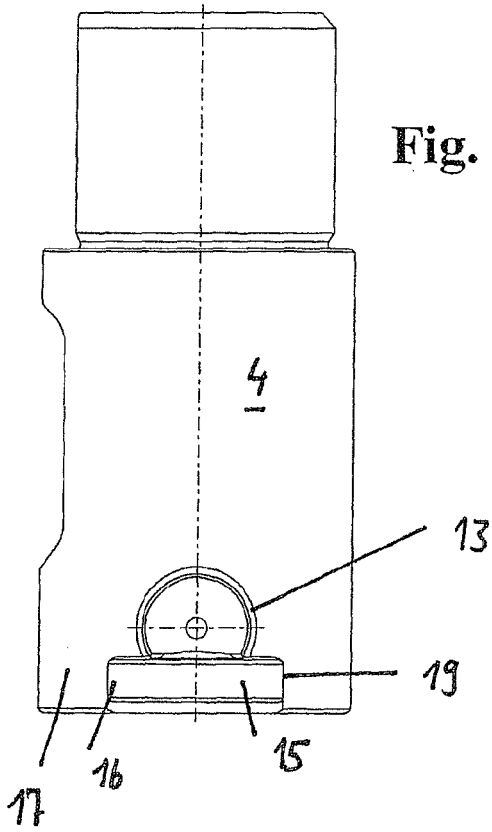

FIGS. 4 and 5 disclose an alternative configuration of the bridge component 1. This is configured here as a short ring segment 15 and seated in a groove 19 on the outer peripheral surface 17 of the one part 4. In place of the ring segment 15, it is also conceivable and intended to use a "straight" disk or the like.

Figure 6:
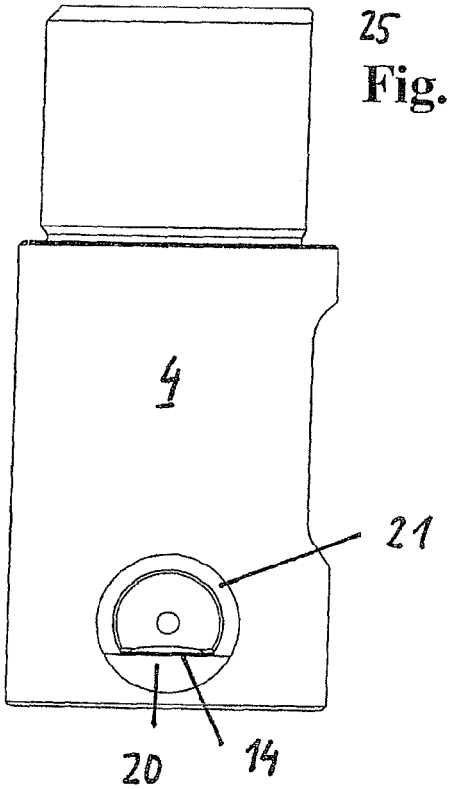
FIGS. 6, 7 are views of a further embodiment comprising a bridge component configured as a bottom segment of a small tube.
Figure 7:
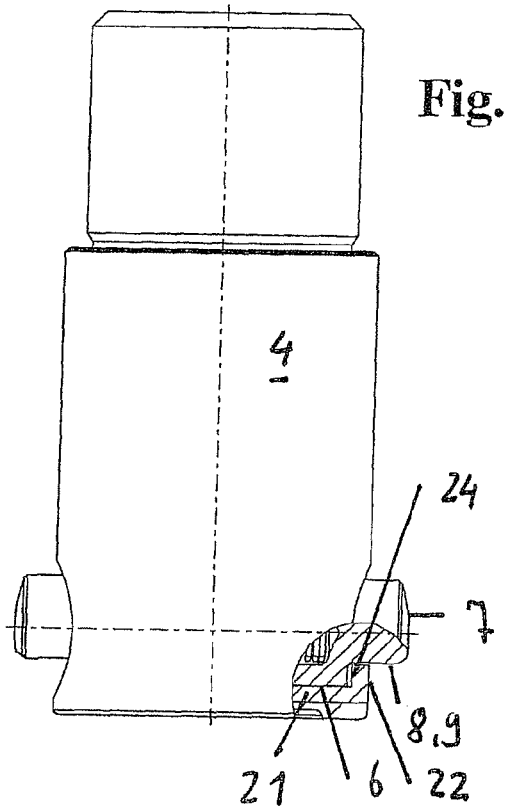

Finally, FIGS. 6 and 7 show a further variant of the bridge component 1. In this case, the bridge component 1 is a bottom segment 20 of a thin-walled small tube 21 extending in the bore 6 of the one part 4. The tube 21 is pressed into the bore 6.

For manufacturing the tube 21, it is advantageous to make this with a pot shape by deep drawing and then punch out a partial region of its bottom so that only the bottom segment 20 is left over. As illustrated, an underside 22 of the bottom segment 20 is flush with the outer peripheral surface 17 of the one part 4. It is clear in this context, that the ring 18 or the ring-segment 15 of the preceding embodiments advantageously likewise do not protrude beyond the outer peripheral surface 17 of the one part 4.

LIST OF REFERENCE NUMERALS

1 Anti-rotation device, bridge component
2 Coupling piston
3 Component
4 Part
5 Part
6 Bore
7 Front end
8 Side
9 Flattened portion
10 Servo means
11 Entraining surface
12 Cam resetting spring
13 Opening
14 Transverse surface
15 Ring segment
16 End
17 Outer peripheral surface
18 Ring
19 Groove
20 Bottom segment
21 Tube
22 Underside
23 Opening
24 Inner side
25 Transverse shoulder

The invention claimed is:

1. An anti-rotation device for a coupling piston in a switchable component of a valve train of an internal combustion engine, said component comprising two parts that are movable relative to each other, said coupling piston being displaced by a first servo into a bore of one of the two parts for achieving uncoupling via a low or zero valve lift, said coupling piston comprising, at least on one side, a flattened portion starting from a front end of the coupling piston facing another one of the two parts, and via the flattened portion, during a relative movement of the two parts, the coupling piston is displaced by a second servo onto an entraining surface arranged on the other one of the two parts for achieving coupling for a high valve lift, and a cam resetting spring is clamped between the two parts, the anti-rotation device is configured as a partial region of an opening of the bore on a bridge component formed as a continuous ring that extends around the one part, and the coupling piston is guided through its flattened portion on a bowstring-like transverse surface of the bridge component.

2. The anti-rotation device of claim 1, wherein the bridge component is made as a plate or ring segment that is seated firmly through ends on an outer peripheral surface of the one part.

3. The anti-rotation device of claim 1, wherein the bridge component is configured as a ring surrounding an outer peripheral surface of the one part.

4. The anti-rotation device of claim 2, wherein ends of the plate or ring segment or the bridge component as a ring is seated in a complementary groove on the outer peripheral surface of the one part.

5. The anti-rotation device of claim 2, wherein the bridge component is fixed on the one part by a welded, soldered, snapped or interference connection.

6. The anti-rotation device of claim 1, wherein the bridge component is seated within the bore of the one part directly in a region of the opening.

7. The anti-rotation device of claim 1, wherein the bridge component is made of a light-weight sheet steel or aluminum sheet.

8. The anti-rotation device of claim 1, wherein the flattened portion is an integral part of the coupling piston.

9. The anti-rotation device of claim 1, wherein the entraining surface on the other part is a constituent part of one of a window-like opening, an annular groove segment, an annular groove or a bar.

10. The anti-rotation device of claim 1, wherein an outward movement limitation for the coupling piston is formed through a transverse shoulder on an inner side of the bridge component.

11. The anti-rotation device of claim 1, wherein the switchable component is one of a support element, a roller tappet, a cup-shaped tappet or a lever system.

12. An anti-rotation device for a coupling piston in a switchable component of a valve train of an internal combustion engine, said component comprising two parts that are movable relative to each other, said coupling piston being displaced by a first servo into a bore of one of the two parts for achieving uncoupling via a low or zero valve lift, said coupling piston comprising, at least on one side, a flattened portion starting from a front end of the coupling piston facing another one of the two parts, and via the flattened portion, during a relative movement of the two parts, the coupling piston is displaced by a second servo onto an entraining surface arranged on the other one of the two parts for achieving coupling for a high valve lift, and a cam resetting spring is clamped between the two parts, the anti-rotation device is configured as a partial region of an opening of the bore on a bridge component spanning the one part, and the coupling piston is guided through its flattened portion on a bowstring-like transverse surface of the bridge component, wherein the bridge component is seated within the bore of the one part directly in a region of the opening, and the bridge component is configured as a bottom segment of a small tube extending in the bore of the one part.

13. The anti-rotation device of claim 12, wherein an underside of the bottom segment is flush with the outer peripheral surface of the one part.

14. The anti-rotation device of claim 12, wherein the small tube is pressed into the bore of the one part.

* * * * *